US011897080B2

(12) United States Patent
Kabasawa et al.

(10) Patent No.: US 11,897,080 B2
(45) Date of Patent: Feb. 13, 2024

(54) POLISHING APPARATUS

(71) Applicant: EBARA CORPORATION, Tokyo (JP)

(72) Inventors: Masashi Kabasawa, Tokyo (JP); Yasuyuki Motoshima, Tokyo (JP); Hisanori Matsuo, Tokyo (JP); Keisuke Kamiki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 144 days.

(21) Appl. No.: 17/065,787

(22) Filed: Oct. 8, 2020

(65) Prior Publication Data

US 2021/0114164 A1 Apr. 22, 2021

(30) Foreign Application Priority Data

Oct. 16, 2019 (JP) ..... 2019-189304

(51) Int. Cl.
*B24B 37/015* (2012.01)
*B24B 37/20* (2012.01)
*B24B 37/013* (2012.01)

(52) U.S. Cl.
CPC ..... *B24B 37/015* (2013.01); *B24B 37/013* (2013.01); *B24B 37/20* (2013.01)

(58) Field of Classification Search
CPC ..... B24B 37/015; B24B 37/013; B24B 37/20
USPC ..... 451/5, 41, 53, 287, 398, 449
See application file for complete search history.

(56) References Cited

U.S. PATENT DOCUMENTS 6,315,635 B1 * 11/2001 Lin ..... B24B 57/02 451/7
2003/0104769 A1 * 6/2003 Brunelli ..... B24B 53/017 451/28
2006/0226123 A1 * 10/2006 Birang ..... B24B 49/105 438/692
2010/0151771 A1 * 6/2010 Nabeya ..... B24B 37/015 451/7
2012/0040592 A1 * 2/2012 Chen ..... B24B 37/015 451/449

(Continued)

FOREIGN PATENT DOCUMENTS

JP 2001-162517 A 6/2001
JP 2005-056987 A 3/2005

(Continued)

OTHER PUBLICATIONS

Machine Generated English Translation of JP2016006856, Published Jan. 14, 2016, 13 pages. (JP2016006856 submitted with the IDS that the applicant submitted on Feb. 1, 2023) (Year: 2016).*

(Continued)

*Primary Examiner* — Joel D Crandall
*Assistant Examiner* — Shantese L McDonald
(74) *Attorney, Agent, or Firm* — PEARNE & GORDON LLP

(57) ABSTRACT

There is disclosed a polishing apparatus which can regulate a surface temperature of the polishing pad without causing a defect such as a scratch on a substrate such as a wafer. The polishing apparatus includes: a non-contact type pad-temperature regulating device; a pad-temperature measuring device. The pad-temperature measuring device is arranged adjacent to the pad-temperature regulating device and on a downstream side of the pad-temperature regulating device in a rotation direction of a polishing table.

13 Claims, 10 Drawing Sheets

(56) References Cited

U.S. PATENT DOCUMENTS

2014/0004626 A1* 1/2014 Xu ..... B24B 37/015
257/E21.528

FOREIGN PATENT DOCUMENTS

| | | | | | |
|---|---|---|---|---|---|
| JP | 2006-196696 | A | | 7/2006 | |
| JP | 2006196696 | | * | 7/2006 | ..... H01L 21/56 |
| JP | 2012-148376 | A | | 8/2012 | |
| JP | 2016-006856 | A | | 1/2016 | |
| JP | 2016006856 | | * | 1/2016 | ..... B24B 55/00 |
| JP | 2018-030181 | A | | 3/2018 | |
| JP | 2018-176339 | A | | 11/2018 | |
| WO | 2019/099399 | A1 | | 5/2019 | |

OTHER PUBLICATIONS

Machine Generated English Translation of JP2006196696, Published Jul. 27, 2006, 17 pages. (JP2006196696 submitted with the IDS that the submitted on Oct. 2, 2020) (Year: 2006).*

* cited by examiner

POLISHING APPARATUS

CROSS REFERENCE TO RELATED APPLICATION

This document claims priority to Japanese Patent Application Number 2019-189304 filed Oct. 16, 2019, the entire contents of which are hereby incorporated by reference.

BACKGROUND

There is a polishing apparatus that holds a wafer by a top ring, rotates the wafer, and presses the wafer against a polishing pad on a rotating polishing table to polish a surface of the wafer. During polishing, a polishing liquid (slurry) is supplied to the polishing pad, and the surface of the wafer is planarized by the chemical action of the polishing liquid and the mechanical action of the abrasive grains contained in the polishing liquid.

A polishing rate of the wafer depends not only on a polishing load of the wafer on the polishing pad but also on a surface temperature of the polishing pad. This is because the chemical action of the polishing liquid on the wafer depends on the temperature. Therefore, in a manufacture of semiconductor devices, it is important to keep the surface temperature of the polishing pad at an optimum value during wafer polishing in order to increase the wafer polishing rate and keep it constant. Therefore, there is a pad temperature regulating device for regulating the surface temperature of the polishing pad.

However, since the pad temperature regulating device brings a heating object, which is one of components of the temperature regulating device, into contact with the polishing pad, the heating object inevitably comes into contact with the polishing liquid on the polishing pad. Therefore, in the case of such a configuration, the wafer may be contaminated due to the contact between the heating object and the polishing pad. Further, when the polishing liquid adheres (fixes) to the heating object, the adhered polishing liquid may drop as a foreign matter from the heating object and come into contact with the wafer. As a result, defects such as scratches are generated on the wafer.

SUMMARY OF THE INVENTION

According to an embodiment, there is provided a polishing apparatus capable of regulating the surface temperature of the polishing pad without causing a defect such as a scratch on the substrate such as a wafer.

Embodiments, which will be described below, relate to a polishing apparatus.

In an embodiment, there is provided a polishing apparatus, comprising: a polishing table configured to support a polishing pad; a polishing head configured to press a substrate against the polishing pad; a non-contact type pad-temperature regulating device arranged above the polishing pad; a pad-temperature measuring device configured to measure a surface temperature of the polishing pad, the pad-temperature measuring device being arranged adjacent to the pad-temperature regulating device and on a downstream side of the pad-temperature regulating device in a rotation direction of the polishing table; and a controller configured to control the pad-temperature regulating device based on the surface temperature of the polishing pad measured by the pad-temperature measuring device.

In an embodiment, the pad-temperature regulating device comprises an infrared heater configured to radiate infrared rays to a surface of the polishing pad.

In an embodiment, the pad-temperature regulating device comprises a reflector configured to reflect the infrared rays radiated from the infrared heater toward the polishing pad.

In an embodiment, the pad-temperature regulating device comprises a suction nozzle configured to decrease an ambient temperature by sucking hot air adjacent to a surface of the polishing pad.

In an embodiment, the pad-temperature regulating device comprises a fan configured to form a flow of air toward a surface of the polishing pad.

In an embodiment, the pad-temperature regulating device comprises a plurality of infrared heaters arranged in a radial direction of the polishing pad, and the controller individually controls each of the infrared heaters to partially change the surface temperature of the polishing pad.

In an embodiment, the polishing apparatus further comprises a film-thickness measuring device configured to measure a film thickness of the substrate, and the controller determines a target temperature of the polishing pad based on the film thickness of the substrate measured by the film-thickness measuring device to control the pad-temperature regulating device based on the determined target temperature.

In an embodiment, the pad-temperature regulating device comprises a heating fluid nozzle configured to spray a heating fluid onto a surface of the polishing pad.

In an embodiment, the pad-temperature regulating device comprises a suction nozzle configured to suck a heat of the surface of the polishing pad, and the heating fluid nozzle comprises a plurality of supply ports arranged around a suction port of the suction nozzle so that the heating fluid flows toward the suction port of the suction nozzle.

In an embodiment, the supply ports are inclined at a predetermined angle toward the suction port of the suction nozzle so that swirling flows toward the suction port of the suction nozzle are formed by the heating fluid.

In an embodiment, the controller controls the pad-temperature regulating device so that a flow rate of the fluid sucked by the suction nozzle is equal to or higher than a flow rate of the heating fluid supplied from the heating fluid nozzle.

In an embodiment, the pad-temperature regulating device comprises a cooling device configured to cool a surface of the polishing pad.

The pad-temperature regulating device is arranged above the polishing pad.

Therefore, the pad-temperature regulating device can regulate the surface temperature of the polishing pad without causing a defect on a wafer.

DESCRIPTION OF EMBODIMENTS

Figure 1:
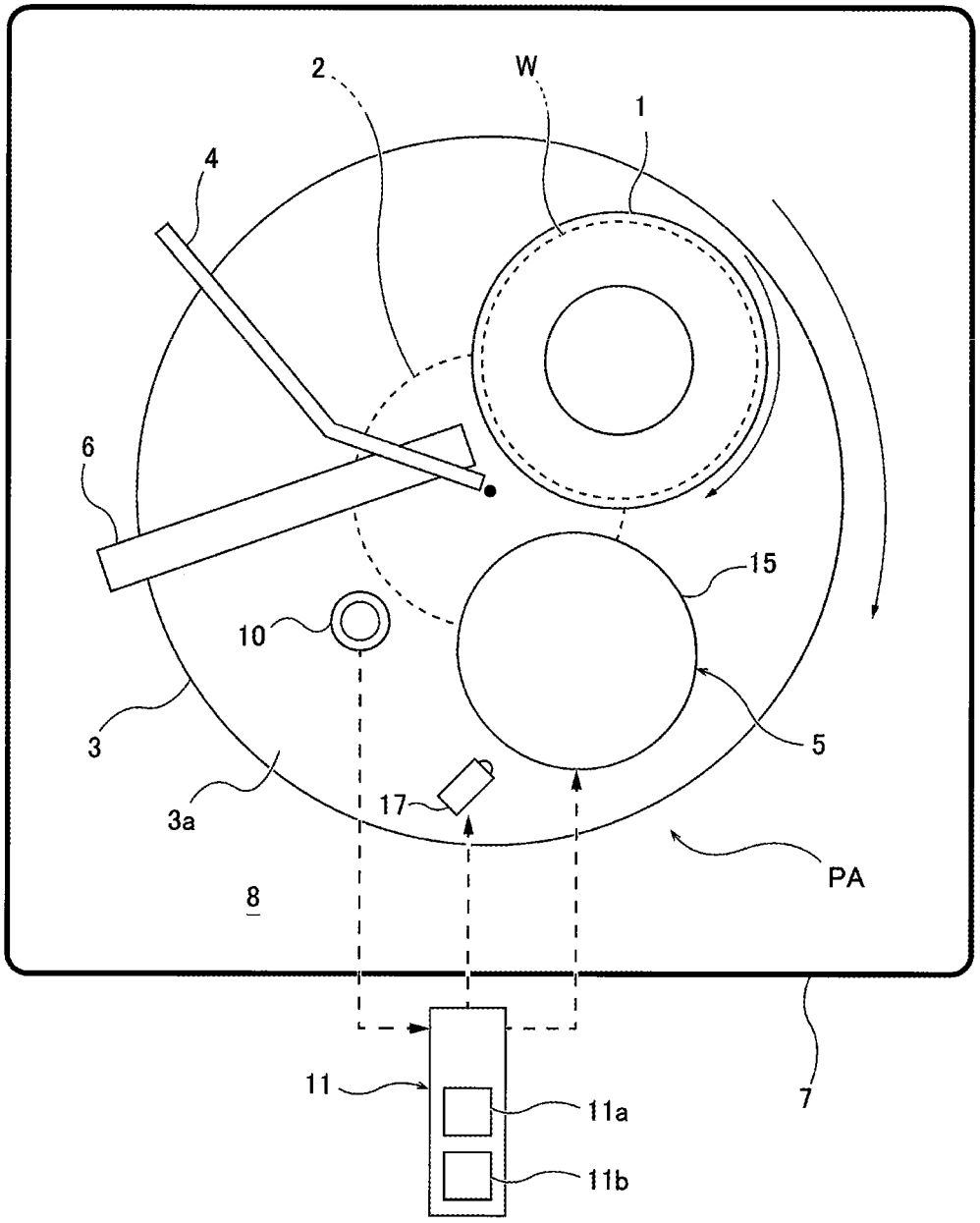
FIG. 1 is a plan view showing a polishing apparatus.

FIG. 1 is a plan view showing the polishing apparatus PA. As shown in FIG. 1, the polishing apparatus PA includes a polishing head 1 for holding and rotating a wafer W that is an example of a substrate, a polishing table 2 that supports a polishing pad 3, and a polishing-liquid supply nozzle 4 for supplying a polishing liquid (e.g., slurry) onto a surface (i.e., polishing surface 3*a*) of the polishing pad 3, a pad-temperature regulating device 5 for regulating a surface temperature of the polishing pad 3, and an atomizer 6 for cleaning the polishing surface 3*a* by spraying a cleaning fluid onto the polishing surface 3*a* of the polishing pad 3. The polishing apparatus PA is arranged inside a polishing chamber 8 formed by a partition wall 7.

The polishing head 1 is vertically movable, and is rotatable about its axis in a direction indicated by arrow. The wafer W is held on a lower surface of the polishing head 1 by, for example, vacuum. A motor (not shown) is coupled to the polishing table 2 and is rotatable in the direction indicated by arrow. As shown in FIG. 1, the polishing head 1 and the polishing table 2 rotate in the same direction. The polishing pad 3 is attached to the upper surface of the polishing table 2.

The polishing apparatus PA may further include a dresser (not shown) for dressing the polishing pad 3 on the polishing table 2. The dresser is configured to swing on the polishing surface 3*a* of the polishing pad 3 in the radial direction of the polishing pad 3.

A polishing of the wafer W is performed as follows. The wafer W to be polished is held by the polishing head 1 and further rotated by the polishing head 1. On the other hand, the polishing pad 3 is rotated together with the polishing table 2. In this state, the polishing liquid is supplied from the polishing-liquid supply nozzle 4 to the polishing surface 3*a* of the polishing pad 3, and the surface of the wafer W is pressed against the polishing surface 3*a* of the polishing pad 3 by the polishing head 1. The surface of the wafer W is polished by sliding contact with the polishing pad 3 in the presence of a polishing liquid. The surface of the wafer W is flattened by the chemical action of the polishing liquid and the mechanical action of the abrasive grains contained in the polishing liquid.

As shown in FIG. 1, the polishing apparatus PA includes a pad-temperature measuring device 10 for measuring the surface temperature of the polishing pad 3 (i.e., temperature of the polishing surface 3*a*) and a controller 11 for controlling the pad-temperature regulating device 5 based on the surface temperature of the polishing pad 3 measured by the pad-temperature measuring device 10. In FIG. 1, although the controller 11 is arranged outside the partition wall 7, the controller 11 may be arranged inside the partition wall 7.

Figure 2:
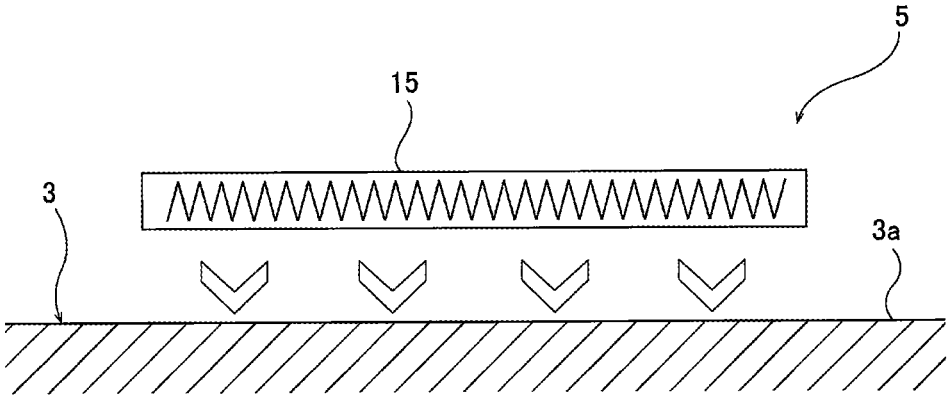
FIG. 2 is a view showing a pad-temperature regulating device arranged above a polishing pad.

FIG. 2 is a view showing the pad-temperature regulating device 5 arranged above the polishing pad 3. As shown in FIG. 2, the pad-temperature regulating device 5 is a non-contact type pad-temperature regulating device arranged above the polishing surface 3*a* of the polishing pad 3. The pad-temperature regulating device 5 includes a heating device (infrared heater) 15 extending parallel to the polishing surface 3*a* of the polishing pad 3.

The infrared heater 15 radiates infrared rays (radiant heat) to the polishing surface 3*a* of the polishing pad 3. In this embodiment, the infrared heater 15 has a disk shape arranged in parallel to the polishing pad 3 (i.e., in the horizontal direction), but the shape of the infrared heater 15 is not limited to this embodiment. In one embodiment, the infrared heater 15 may have a rectangular shape extending in the radial direction of the polishing pad 3. In one embodiment, the infrared heater 15 may be configured to swing along the radial direction of the polishing pad 3.

As shown in FIG. 2, the infrared heater 15 is arranged above the polishing pad 3. More specifically, the infrared heater 15 is arranged at a height that does not adhere to the polishing liquid supplied onto the polishing surface 3*a* of the polishing pad 3 and that can heat the polishing surface 3*a*. With this arrangement, the pad-temperature regulating device 5 can prevent the wafer W from being contaminated due to the contact between the infrared heater 15 and the polishing pad 3, and further prevent the polishing liquid from adhering to the infrared heater 15. Therefore, the wafer W is free from defects such as scratches.

As shown in FIG. 1, the pad-temperature measuring device 10 is arranged adjacent to the pad-temperature regulating device 5 and on the downstream side of the pad-temperature regulating device 5 in the rotation direction of the polishing table 2. In one embodiment, the pad-temperature measuring device 10 may be arranged to measure the surface temperature of the polishing pad 3 at a plurality of points along the radial direction of the polishing pad 3. When the pad-temperature regulating device 5 is used as a reference, a region between the pad-temperature regulating device 5 and the polishing head 1 is a region on the upstream side of the pad-temperature regulating device 5, and a region between the pad-temperature regulating device 5 and the atomizer 6 is a region on the downstream side of the pad-temperature regulating device 5.

By disposing the pad-temperature measuring device 10 on the downstream side of the pad-temperature regulating device 5, the polishing apparatus PA can achieve the following effects. When the wafer W held by the polishing head 1 is polished, a difference in temperature of the polishing surface 3*a* between an upstream region and a downstream region of the polishing head 1 in the rotation direction of the polishing table 2 occurs due to a polishing heat and a heat absorption by the wafer W. If the pad-temperature measuring device 10 is arranged in a region between the downstream side of the polishing head 1 and the pad-temperature regulating device 5 to control the temperature of this region, the difference in temperature becomes a disturbance factor, which not only causes a delay in temperature control but also has a great potential to cause instability in temperature control. In this embodiment, the pad-temperature measuring device 10 is disposed on the downstream side of the pad-temperature regulating device 5. Therefore, the controller 11 can control the temperature of the polishing surface 3*a* based on the temperature of the polishing surface 3*a* at the downstream side of the pad-temperature regulating device 5 without being affected by the disturbance factors. As a result, the delay in temperature control can be reduced and a more stable temperature control can be performed.

In one embodiment, the polishing apparatus PA may include a pad-temperature measuring device (not shown) which is arranged at a region (i.e., upstream side of the pad-temperature regulating device 5) between the pad-temperature regulating device 5 and the polishing head 1 in addition to the pad-temperature measuring device 10 arranged on the down stream side of the pad-temperature regulating device 5. This pad-temperature measuring device may have the same structure as the pad-temperature measuring device 10 (see FIG. 1) or may have a different structure.

The pad-temperature measuring device 10 measures the surface temperature of the polishing pad 3 in contact or non-contact and sends the measured value of the surface temperature to the controller 11. The pad-temperature measuring device 10 may measure the surface temperature of the polishing pad 3 every predetermined time. The controller 11 controls the pad-temperature regulating device 5 (more specifically, the infrared heater 15) based on the measured surface temperature so that the surface temperature of the polishing pad 3 is maintained at a preset target temperature. For example, the controller 11 performs feedback control (more specifically, PID control) of the pad-temperature regulating device 5 based on the surface temperature measured by the pad-temperature measuring device 10.

The controller 11 includes a memory 11*a* for storing a program and a processer 11*b* for executing a calculation according to the program. The controller 11 including a computer operates according to a program electrically stored in the memory 11*a*. The program includes at least a command to operate the pad-temperature regulating device 5.

The program is stored in a non-transitory tangible computer-readable storage medium. The controller 11 is provided with the program via the storage medium. The program may be input to the controller 11 from a communication device (not shown) via a communication network, such as the Internet or local area network.

Figure 3:
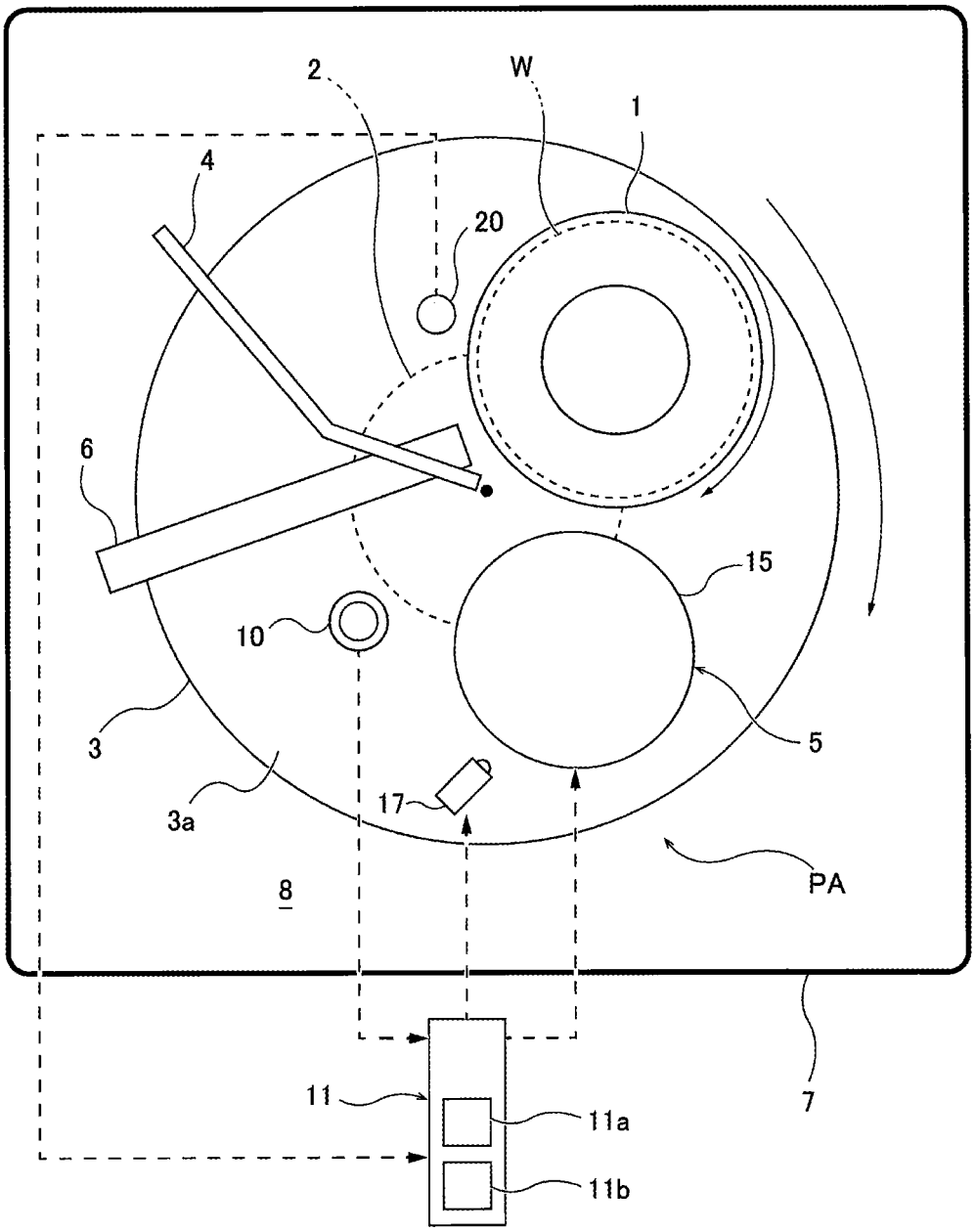
FIG. 3 is a view showing another embodiment of the polishing apparatus.

FIG. 3 is a view showing another embodiment of the polishing apparatus PA. Configurations and operations of the present embodiment, which will not be described particularly, are the same as those of the embodiment described above, and duplicate explanations will be omitted. The controller 11 may determine the target temperature of the polishing pad 3 based on the film thickness of the wafer W that changes with the progress of polishing. As shown in FIG. 3, the polishing table 2 of the polishing apparatus PA may include a film-thickness measuring device 20 for measuring the film thickness of the wafer W. The film-thickness measuring device 20 is electrically connected to the controller 11. The controller 11 may determine the target temperature of the polishing pad 3 based on the film thickness of the wafer W measured by the film-thickness measuring device 20. The controller 11 controls the pad-temperature regulating device 5 based on the determined target temperature so that the surface temperature of the polishing pad 3 is maintained at the target temperature.

In one embodiment, in order to accurately determine a polishing end point of the wafer W, the controller 11 may gradually decrease the target temperature of the polishing pad 3 as the film thickness of the wafer W approaches the target thickness. As described above, the polishing rate of the wafer W depends on the surface temperature of the polishing pad 3. Therefore, by lowering the surface temperature of the polishing pad 3 as the target temperature of the polishing pad 3 decreases, the polishing rate of the wafer W gradually decreases. In this manner, the controller 11 can accurately determine the polishing end point of the wafer W.

In another embodiment, the controller 11 may increase the target temperature of the polishing pad 3 until the film thickness of the wafer W reaches a predetermined thickness, and decrease the target temperature of the polishing pad 3 after the film thickness of the wafer W reaches the predetermined thickness.

An example of the film-thickness measuring device 20 may include an eddy current sensor or an optical sensor. The eddy current sensor is a sensor that detects an interlinkage magnetic flux formed by the eddy current of the wafer W and detects the thickness of the wafer W based on the detected interlinkage magnetic flux. The optical sensor is a sensor that detects the thickness of the wafer W by irradiating the wafer W with light and measuring an interference wave reflected from the wafer W.

In one embodiment, the pad-temperature regulating device 5 may include a cooling device 17 for cooling the polishing surface 3*a* of the polishing pad 3 (see FIG. 1). An example of the cooling device 17 may include a cooling device that sprays gas onto the polishing surface 3*a* to cool the polishing surface 3*a*. As shown in FIG. 1, the cooling device 17 is electrically connected to the controller 11, and the controller 11 can control the cooling device 17 independently of the infrared heater 15. With such a configuration, the controller 11 can more accurately regulate the temperature of the polishing surface 3*a*. Configurations of the pad-temperature regulating device 5 will be described with reference to the drawings.

Figure 4:
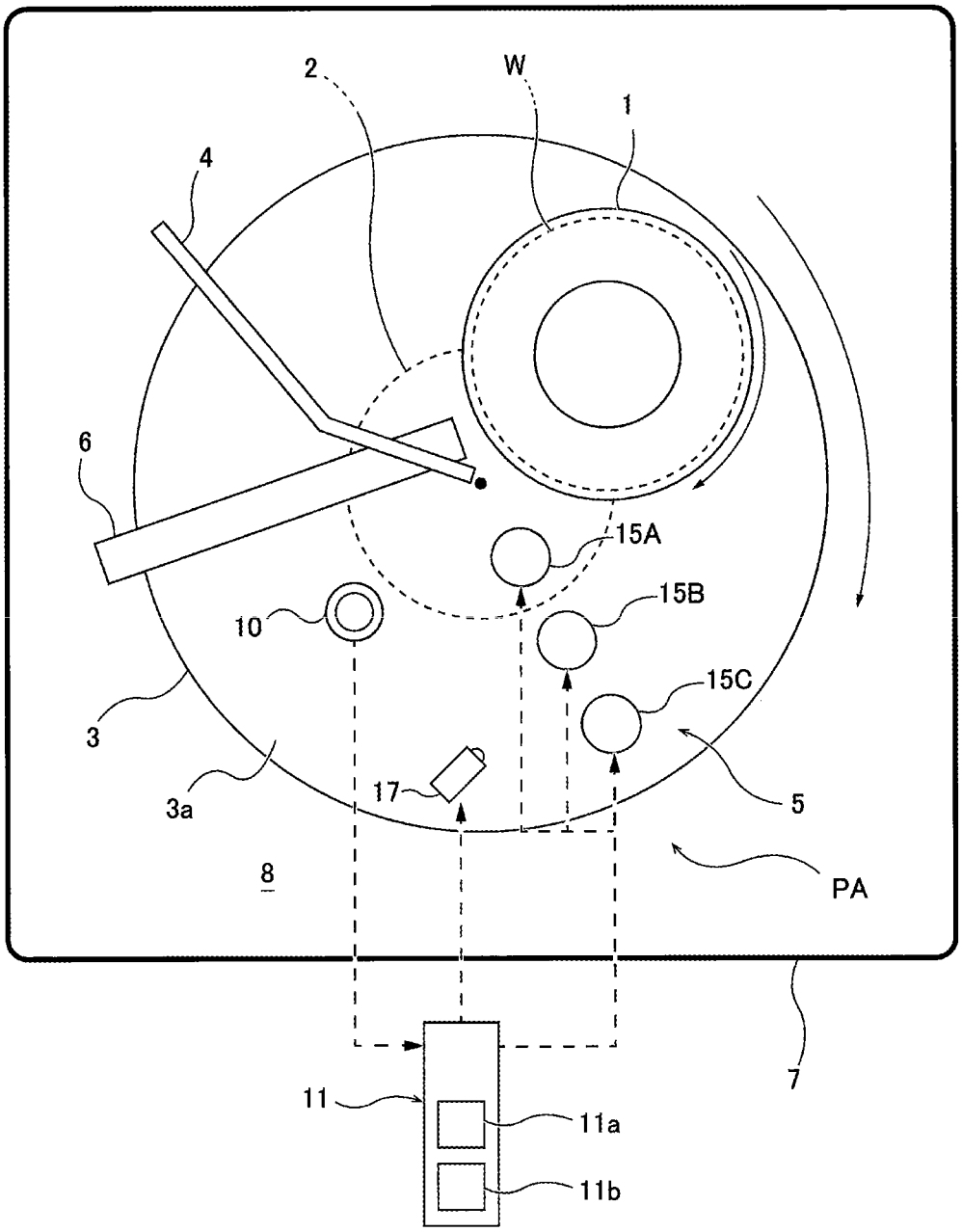
FIG. 4 is view showing a plurality of infrared heaters arranged in a radial direction of the polishing pad.

FIG. 4 is a view showing a plurality of infrared heaters 15A, 15B and 15C arranged in the radial direction of the polishing pad 3. The pad-temperature regulating device 5 includes a plurality (three in the embodiment) of infrared heaters 15A, 15B and 15C arranged in series in the radial direction of the polishing pad 3. The number of infrared heaters is not limited to this embodiment. Two infrared heaters may be provided, or four or more infrared heaters may be provided.

Each of the plurality of infrared heaters 15A, 15B and 15C is electrically connected to the controller 11. The controller 11 can individually control each of the infrared heaters 15A, 15B and 15C, and can partially change the surface temperature of the polishing pad 3. In one embodiment, each infrared heater 15A, 15B and 15C may be configured to be swingable along the radial direction of the polishing pad 3.

Figure 5:
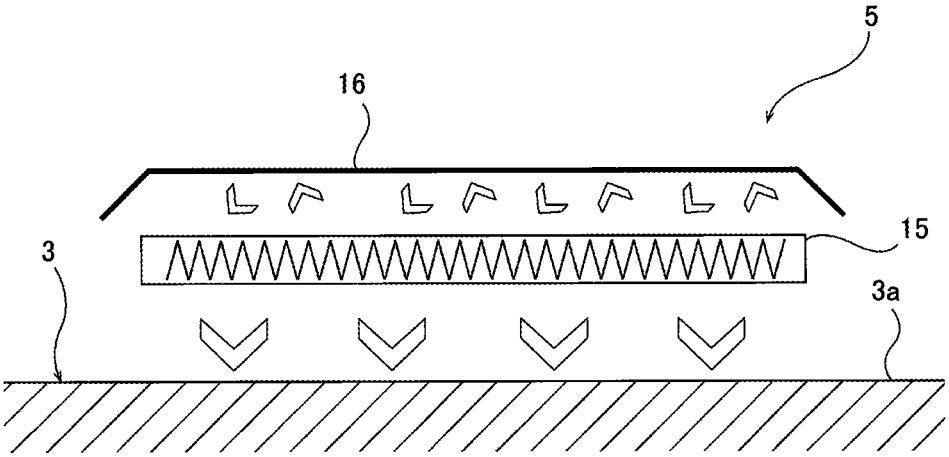
FIG. 5 is a view showing the pad-temperature regulating device including a reflector.

FIG. 5 is a view showing the pad-temperature regulating device 5 including a reflector 16. As shown in FIG. 5, the pad-temperature regulating device 5 may include the reflecting plate 16 for reflecting infrared rays emitted from the infrared heater 15 toward the polishing pad 3. The reflector 16 is arranged above the infrared heater 15 so as to cover the infrared heater 15. The reflector 16 can efficiently reflect the infrared light emitted from the infrared heater 15 by the reflection on the polishing surface 3*a* of the polishing pad 3. In one embodiment, the reflector 16 may be arranged not only above the infrared heater 15 but also laterally to the infrared heater 15.

Figure 6:
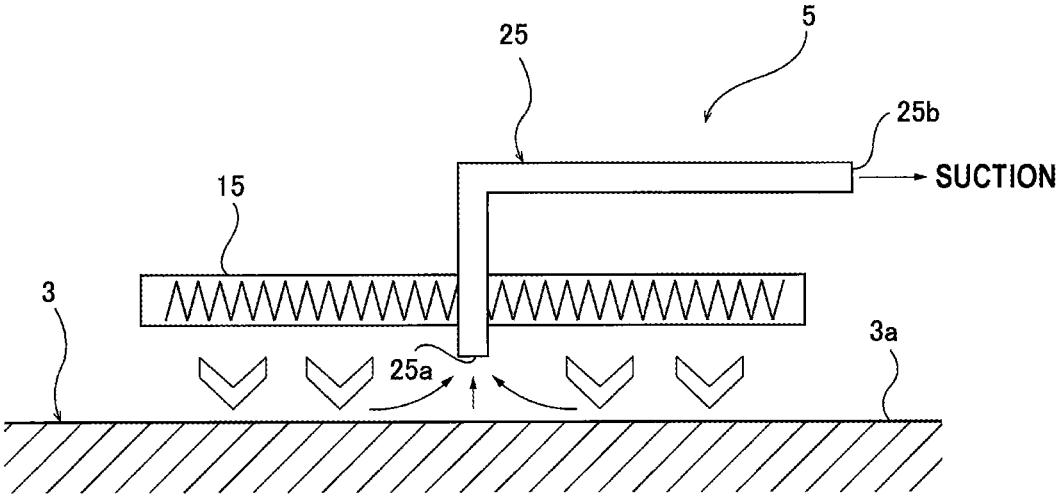
FIG. 6 is a view showing the pad-temperature regulating device including a suction nozzle.
Figure 7:
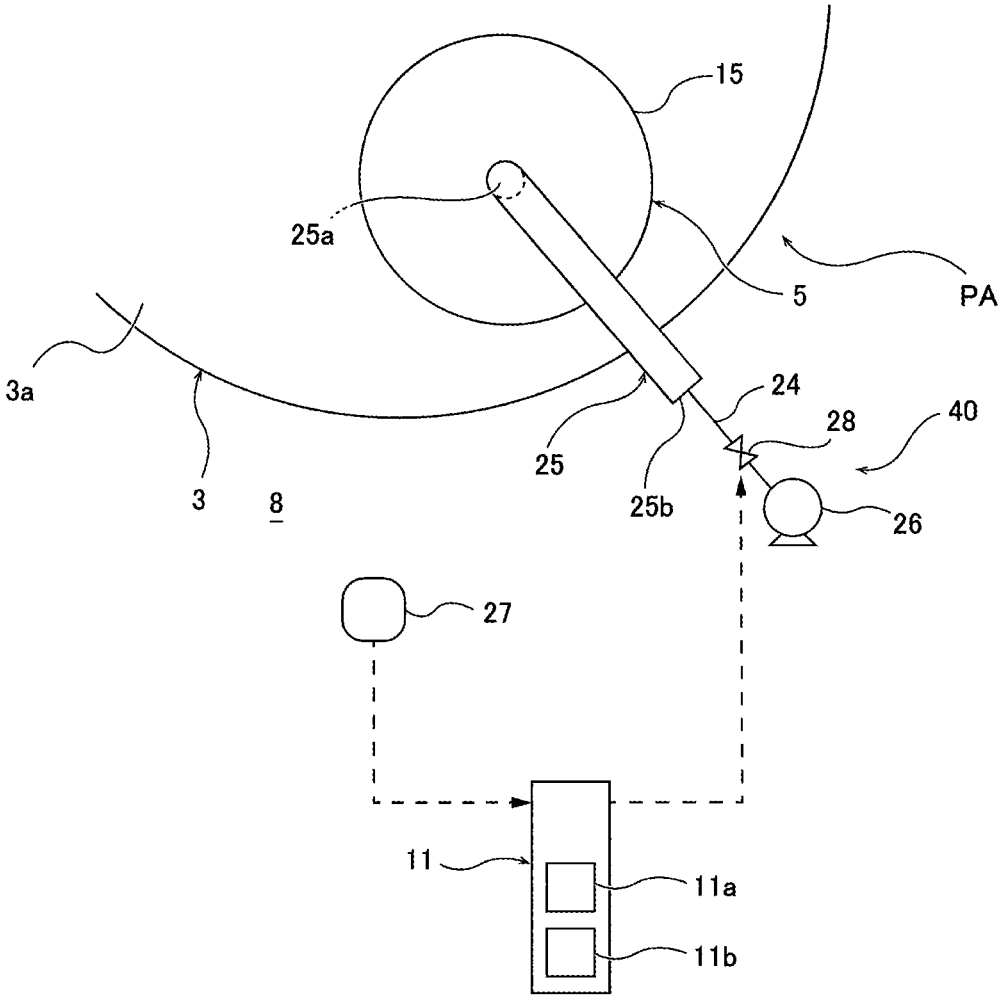
FIG. 7 is a view showing the pad-temperature regulating device including a suction nozzle.

FIGS. 6 and 7 are views showing the pad-temperature regulating device 5 including a suction nozzle 25. As shown in FIGS. 6 and 7, the pad-temperature regulating device 5 may include the suction nozzle 25 for decreasing an ambient temperature by sucking hot air near the polishing surface 3*a* of the polishing pad 3 heated by the infrared heater 15. The suction nozzle 25 sucks in the air above the polishing surface 3*a*, which is adjacent to the polishing surface 3*a*, and decreases the temperature of the air in the polishing chamber 8.

The suction nozzle 25 is connected to a suction device 26. More specifically, a suction port 25*a* of the suction nozzle 25 is disposed above the polishing surface 3*a*, and a connection end 25*b* of the suction nozzle 25 is connected to the suction device 26 via a suction line 24. A control valve 28 is connected to the suction line 24. The suction nozzle 25, the suction line 24, the control valve 28 and the suction device 26 constitute a suction mechanism 40. The pad-temperature regulating device 5 includes the suction mechanism 40.

The suction port 25*a* of the suction nozzle 25 is arranged at a height that does not suck the polishing liquid supplied onto the polishing surface 3*a* of the polishing pad 3 and that can suck the heat of the polishing surface 3*a*. In the embodiment shown in FIG. 7, the suction port 25*a* of the suction nozzle 25 is arranged at the center of the infrared heater 15. However, the location of the suction port 25*a* is not limited to the embodiment shown in FIG. 7.

As described above, the polishing apparatus PA is arranged in the polishing chamber 8 formed by the partition wall 7 (see FIG. 1). Therefore, when the infrared heater 15 is driven, the temperature of the polishing surface 3*a* of the polishing pad 3 may increase and the temperature of the polishing chamber 8 may increase more than necessary. The temperature of the polishing chamber 8 increased more than necessary adversely affects the quality of the wafer W. The suction nozzle 25 can maintain the temperature of the polishing chamber 8 at a predetermined temperature by sucking the heat of the polishing surface 3*a* of the polishing pad 3.

In one embodiment, the polishing apparatus PA may include a temperature sensor 27 arranged in the polishing chamber 8 (see FIG. 7). The temperature sensor 27 is electrically connected to the controller 11, and the temperature of the polishing chamber 8 measured by the temperature sensor 27 is sent to the controller 11. The controller 11 controls the temperature of the polishing chamber 8 measured by the temperature sensor 27 so that the temperature of the polishing chamber 8 is maintained at a predetermined temperature or does not exceed the predetermined temperature.

Figure 8:
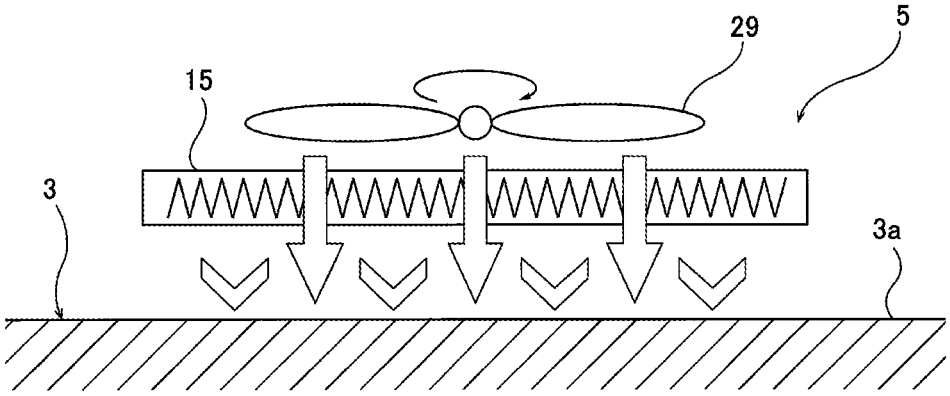
FIG. 8 is a view showing still another embodiment of the pad-temperature regulating device.

FIG. 8 is a view showing still another embodiment of the pad-temperature regulating device 5. Configurations and operations of the present embodiment, which will not be described particularly, are the same as those of the embodiment described above, and duplicate explanations will be omitted. As shown in FIG. 8, the pad-temperature regulating device 5 may include a fan 29 that is arranged adjacent to the infrared heater 15 and forms a flow of air (see arrows in FIG. 8) toward the polishing surface 3*a* of the polishing pad 3.

In the embodiment shown in FIG. 8, the fan 29 is arranged above the infrared heater 15 and is arranged to face the polishing surface 3*a* of the polishing pad 3 via the infrared heater 15. In one embodiment, the fan 29 may be arranged below the infrared heater 15.

The fan 29 is electrically connected to the controller 11, and the controller 11 can drive the fan 29. When the fan 29 is driven while the infrared heater 15 is driven, the air around the fan 29 is sent to the polishing surface 3*a* of the polishing pad 3 as hot air. The controller 11 controls a flow velocity of the air sent by the fan 29 (i.e., wind velocity) to a flow velocity at which the polishing liquid on the polishing pad 3 does not scatter. In the embodiment shown in FIG. 8, a single fan 29 is provided, but the number of fans 29 is not limited to this embodiment. A plurality of fans 29 may be provided.

The controller 11 can control the infrared heater 15 and the fan 29 separately. Therefore, in one embodiment, the controller 11 may drive only the fan 29 without driving the infrared heater 15 based on the surface temperature of the polishing pad 3 measured by the pad-temperature measuring device 10. As a result, the polishing surface 3*a* of the polishing pad 3 is cooled by the air sent by the rotation of the fan 29.

In the above-described embodiment, the pad-temperature regulating device 5 has various configurations. These various configurations may be combined as much as possible if necessary. In particular, the pad-temperature regulating device 5 may include at least one combination selected from the embodiments shown in FIGS. 5, 6 and 8.

Figure 9:
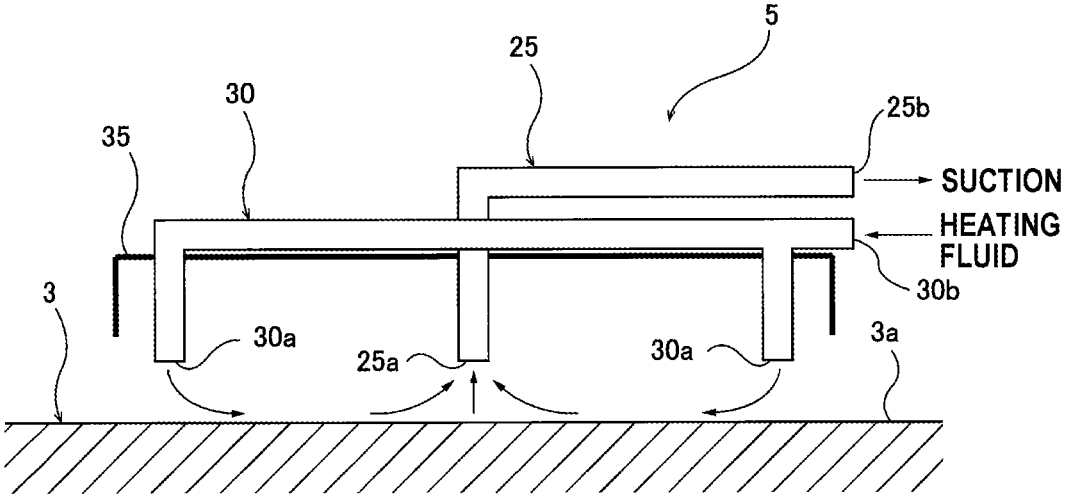
FIG. 9 is a view showing still another embodiment of the pad-temperature regulating device.
Figure 10:
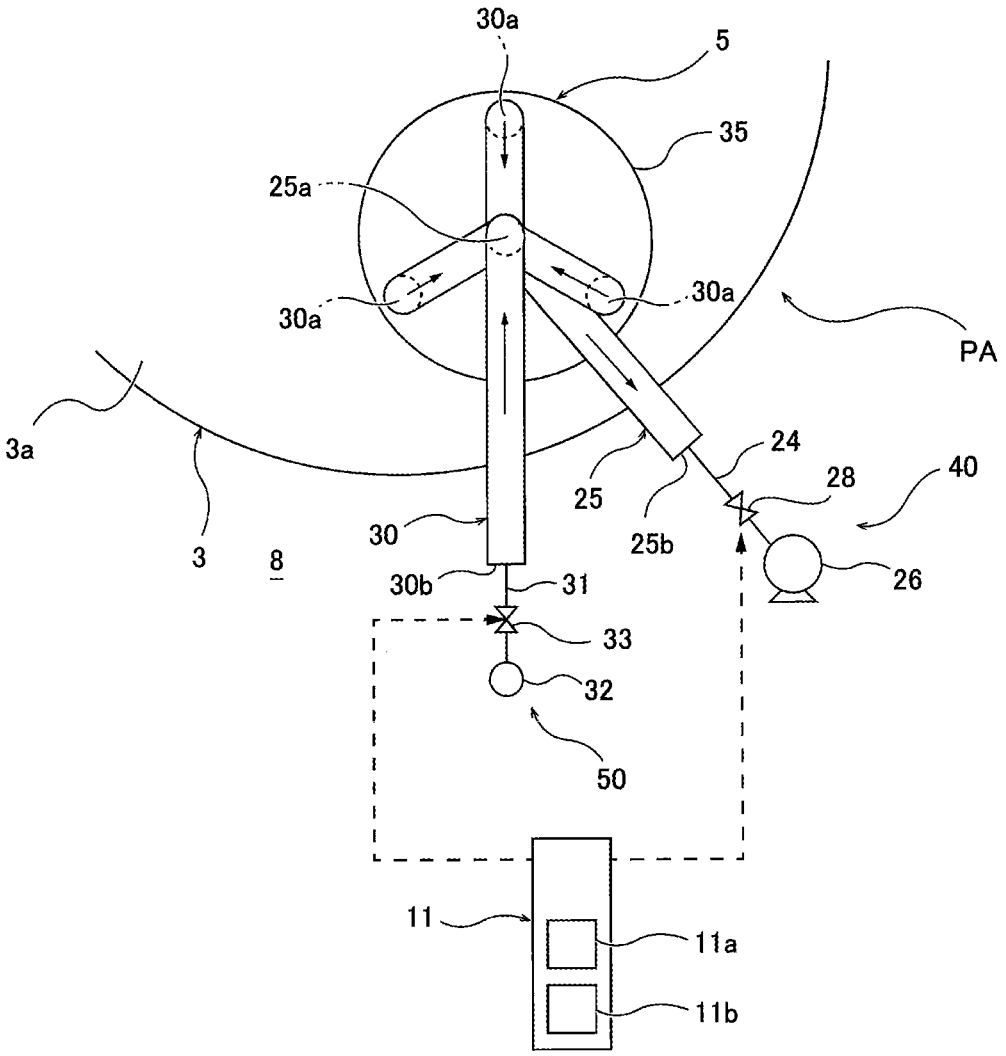
FIG. 10 is a view showing still another embodiment of the pad-temperature regulating device.

FIGS. 9 and 10 are views showing still another embodiment of the pad-temperature regulating device 5. Configurations and operations of the present embodiment, which will not be described particularly, are the same as those of the embodiment described above, and duplicate explanations will be omitted.

In the embodiment shown in FIGS. 9 and 10, the pad-temperature regulating device 5 does not include the infrared heater 15, but instead includes a heating fluid nozzle 30 for spraying a heating fluid onto the polishing surface 3*a* of the polishing pad 3.

The pad-temperature regulating device 5 may include a suction nozzle 25 for sucking the heating fluid supplied from the heating fluid nozzle 30. The suction nozzle 25 has the same configuration as the suction nozzle 25 according to the embodiment shown in FIG. 6. Therefore, the description of the structure of the suction nozzle 25 is omitted.

As shown in FIGS. 9 and 10, the heating fluid nozzle 30 has a plurality of supply ports 30*a* arranged around the suction port 25*a* of the suction nozzle 25 so that the heating fluid flows toward the suction port 25*a* of the suction nozzle 25.

As shown in FIG. 10, the heating fluid nozzle 30 is connected to a heating fluid supply source 32. More specifically, the supply port 30*a* of the heating fluid nozzle 30 is arranged above the polishing surface 3*a*, and a connection end 30*b* of the heating fluid nozzle 30 is connected to the heating fluid supply source 32 via a supply line 31. A control valve 33 is connected to the supply line 31. The heating fluid nozzle 30, the supply line 31, the heating fluid supply source 32, and the control valve 33 constitute a heating mechanism 50. The pad-temperature regulating device 5 includes the heating mechanism 50.

The controller 11 is electrically connected to the control valve 33. When the controller 11 opens the control valve 33, the heating fluid is supplied from the supply port 30*a* of the heating fluid nozzle 30 toward the polishing surface 3*a* of the polishing pad 3 through the supply line 31. Examples of the heating fluid include high-temperature air (i.e., hot air), heated steam and superheated steam. The superheated steam means high temperature steam obtained by further heating saturated steam.

In the embodiment shown in FIG. 10, the three supply ports 30*a* are arranged at equal intervals so as to surround the suction port 25*a* of the suction nozzle 25, but the number of the supply ports 30*a* is not limited to this embodiment. The number of supply ports 30*a* may be two, or may be four or more. The plurality of supply ports 30*a* may be arranged at unequal intervals so as to surround the suction port 25*a*.

As shown in FIGS. 9 and 10, the pad-temperature regulating device 5 may include a heat insulating cover 35 for covering the suction port 25*a* of the suction nozzle 25 and the supply port 30*a* of the heating fluid nozzle 30.

Figure 11:
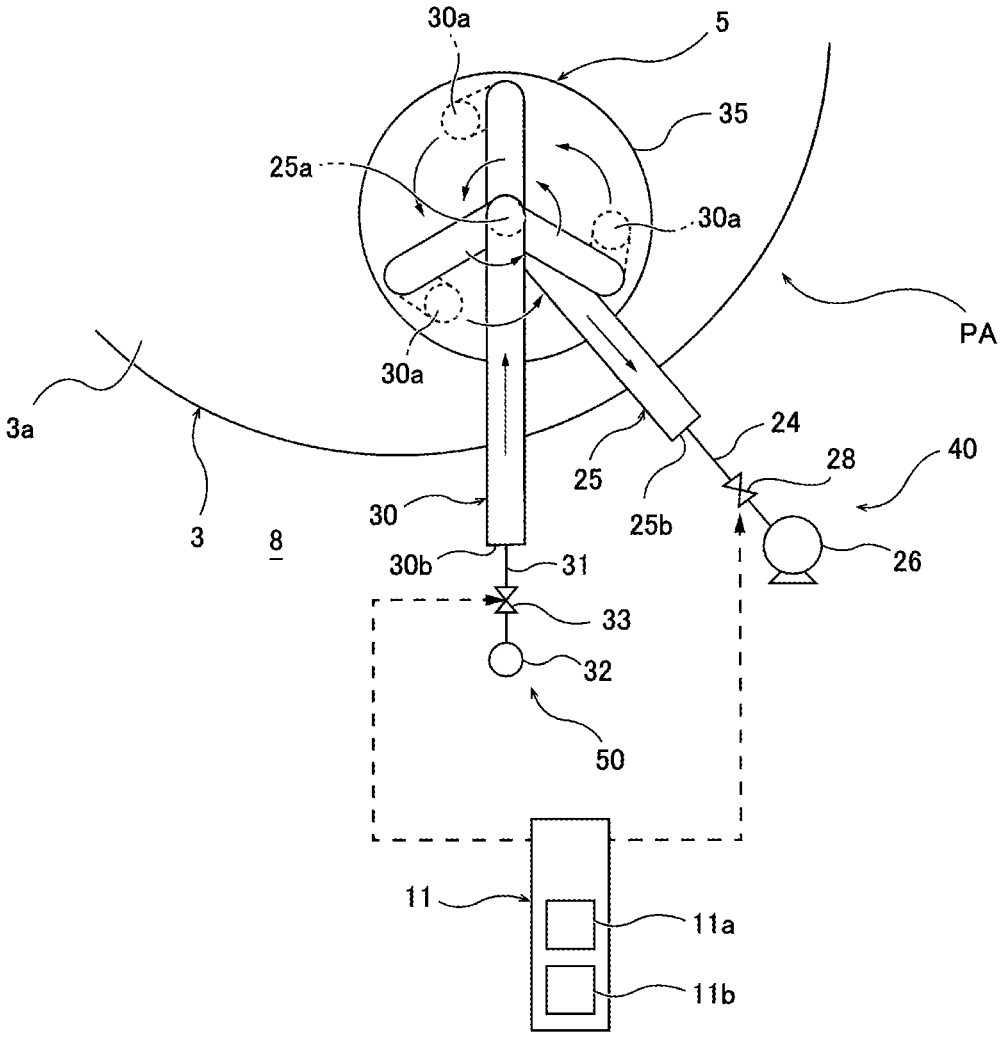
FIG. 11 is a view showing a modification of a heating fluid nozzle according to the embodiment shown in FIG. 10.

FIG. 11 is a view showing a modification of the heating fluid nozzle 30 according to the embodiment shown in FIG.

10. Each supply port 30*a* may be inclined at an angle such that the heating fluid does not spread to the polishing chamber 8 and the polishing liquid on the polishing pad 3 does not scatter. In one embodiment, as shown in FIG. 11, a plurality of (three in the embodiment) supply ports 30*a* are inclined at a predetermined angle toward the suction port 25*a* of the suction nozzle 25 so that swirling flows (see an arc-shaped arrow in FIG. 11) toward the suction port 25*a* of the suction nozzle 25 are formed by the heating fluid. In the embodiment shown in FIG. 11, each supply port 30*a* extends along a circumferential direction of the heat insulating cover 35 and is inclined at a predetermined angle toward the suction port 25*a*.

In a polishing unit that constitutes the polishing chamber 8, since the wafer W is polished using the polishing liquid, the polishing unit is the most dirty area. Therefore, a negative pressure is formed inside the polishing unit (i.e., the polishing chamber 8), and the pressure is kept lower than that of the other units (for example, the cleaning unit). If the pad-temperature regulating device 5 continues to supply the heating fluid through the heating fluid nozzle 30, the pressure in the polishing chamber 8 may increase above a predetermined pressure. Therefore, the controller 11 monitors the pressure in the polishing chamber 8 by means such as a pressure sensor (not shown) arranged in the polishing chamber 8 and maintains the pressure in the polishing chamber 8 at an appropriate pressure. The opening/closing operation of the control valve 33 (and/or the control valve 28) may be controlled.

In one embodiment, the controller 11 controls the pad-temperature regulating device 5 (more specifically, control valve 28 and control valve 33) so that the flow rate of the fluid sucked by the suction nozzle 25 is equal to or higher than the flow rate of the heating fluid supplied from the heating fluid nozzle 30. By such control, the pad-temperature regulating device 5 can maintain the pressure in the polishing chamber 8 at an appropriate pressure and/or suppress the temperature increase in the polishing chamber 8.

Figure 12:
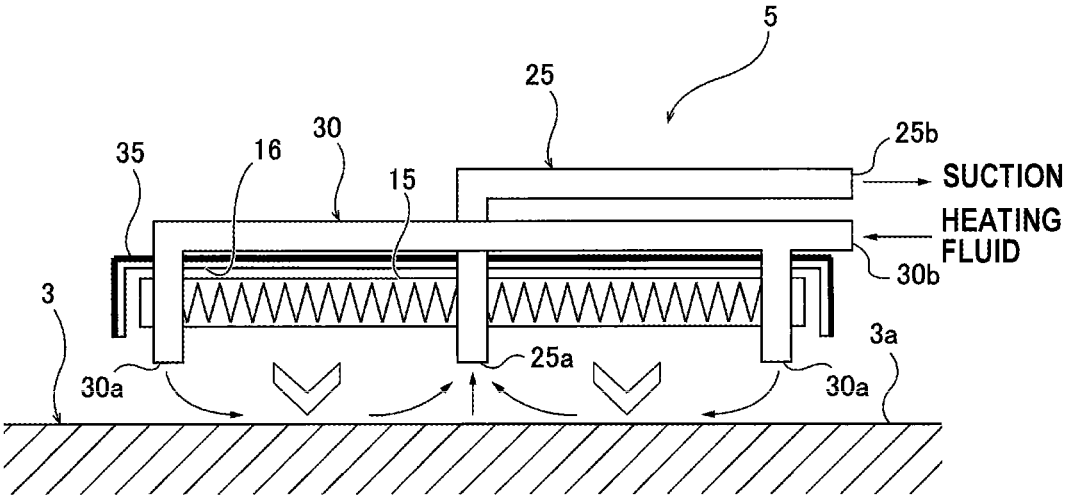
FIG. 12 is a view showing still another embodiment of the pad-temperature regulating device.

FIG. 12 is a view showing still another embodiment of the pad-temperature regulating device 5. As shown in FIG. 12, the embodiment shown in FIG. 5 and the embodiment shown in FIG. 9 may be combined. In the embodiment shown in FIG. 12, the reflector 16 is attached to an inner surface of the heat insulating cover 35. The embodiment shown in FIG. 2 (i.e., the embodiment in which the reflector 16 is not provided) and the embodiment shown in FIG. 9 may be combined.

The surface temperature of the polishing pad 3 can be changed based on the configuration described in the above embodiment. The controller 11 can change the surface temperature of the polishing pad 3 by employing at least one of the means, for example, a means for changing the magnitude of the current supplied to the infrared heater 15, a means for changing the angle of the reflector 16, a means for changing the distance between the infrared heater 15 and the polishing surface 3*a* of the polishing pad 3, means for changing the rotation speed of the fan 29 and the means for changing the angle at which the heating fluid is applied to the polishing surface 3*a* of the polishing pad 3.

When changing the angle of the reflector 16, the controller 11 may control the operation of a motor (not shown) capable of changing the angle of the reflector 16. When changing the distance between the infrared heater 15 and the polishing surface 3*a* of the polishing pad 3, the controller 11 may control the operation of a motor (not shown) capable of adjusting the height of the infrared heater 15. When changing the angle at which the heating fluid is applied to the polishing surface 3*a*, the controller 11 may control the operation of a motor (not shown) capable of changing the angle of the heating fluid nozzle 30.

In the embodiment shown in FIG. 4, an example in which the surface temperature of the polishing pad 3 is partially changed has been described, but the surface temperature of the polishing pad 3 may be partially changed by the means described below. For example, the controller 11 can change partially the surface temperature of the polishing pad 3 by employing at least one of the means for changing the angle of the reflector 16, the means for changing the orientation angle of the infrared heater 15, and the means for changing the angle at which the heating fluid is applied.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus, comprising:

a polishing pad having a polishing surface, a polishing table configured to support the polishing pad;

a polishing head configured to press a substrate against the polishing pad;

a non-contact pad-temperature regulating device arranged above the polishing pad;

a pad-temperature measuring device configured to measure a surface temperature of the polishing pad, the pad-temperature measuring device being arranged adjacent to the pad-temperature regulating device and on a downstream side of the pad-temperature regulating device in a rotation direction of the polishing table;

an atomizer configured to clean the polishing surface of the polishing pad; and a controller configured to control the pad-temperature regulating device based on the surface temperature of the polishing pad measured by the pad-temperature measuring device, wherein the pad-temperature measuring device is arranged on the downstream side of the pad-temperature regulating device and on an upstream side of the atomizer, and wherein when a region between the atomizer and the pad-temperature regulating device is defined as a temperature control stable region, the pad-temperature measuring device is arranged in the temperature control stable region, and the polishing head is arranged in a region outside the temperature control stable region.

2. The polishing apparatus according to claim 1, wherein the pad-temperature regulating device comprises an infrared heater configured to radiate infrared rays to a surface of the polishing pad.

3. The polishing apparatus according to claim 2, wherein the pad-temperature regulating device comprises a reflector configured to reflect the infrared rays radiated from the infrared heater toward the polishing pad.

4. The polishing apparatus according to claim 1, wherein the pad-temperature regulating device comprises a suction nozzle configured to decrease an ambient temperature by sucking hot air adjacent to the surface of the polishing pad.

5. The polishing apparatus according to claim 1, wherein the pad-temperature regulating device comprises a fan configured to form a flow of air toward a surface of the polishing pad.

6. The polishing apparatus according claim 1, wherein the pad-temperature regulating device comprises a plurality of infrared heaters arranged in a radial direction of the polishing pad, and wherein the controller individually controls each of the infrared heaters to partially change the surface temperature of the polishing pad.

7. The polishing apparatus according to claim 1, further comprising: a film-thickness measuring device configured to measure a film thickness of the substrate, and wherein the controller determines a target temperature of the polishing pad based on the film thickness of the substrate measured by the film-thickness measuring device to control the pad-temperature regulating device based on the determined target temperature.

8. The polishing apparatus according to claim 1, wherein the pad-temperature regulating device comprises a heating fluid nozzle configured to spray a heating fluid onto a surface of the polishing pad.

9. The polishing apparatus according to claim 1, wherein the pad-temperature regulating device comprises a cooling device configured to cool a surface of the polishing pad.

10. The polishing apparatus according to claim 1, wherein the polishing head causes a temperature difference on the polishing surface between an upstream region and a downstream region of the polishing head in the rotation direction of the polishing table, and wherein the temperature control stable region corresponds to the downstream region.

11. A polishing apparatus, comprising:

a polishing pad having a polishing surface a polishing table configured to support the polishing pad;

a polishing head configured to press a substrate against the polishing pad;

a non-contact pad-temperature regulating device arranged above the polishing pad;

a pad-temperature measuring device configured to measure a surface temperature of the polishing pad, the pad-temperature measuring device being arranged adjacent to the pad-temperature regulating device and on a downstream side of the pad-temperature regulating device in a rotation direction of the polishing table; and a controller configured to control the pad-temperature regulating device based on the surface temperature of the polishing pad measured by the pad-temperature measuring device, wherein the pad-temperature regulating device comprises a heating fluid nozzle configured to spray a heating fluid onto the surface of the polishing pad, wherein the pad-temperature regulating device comprises a suction nozzle configured to suck air near a surface of the polishing pad, and wherein the heating fluid nozzle comprises a plurality of supply ports arranged around a suction port of the suction nozzle so that the heating fluid flows toward the suction port of the suction nozzle.

12. The polishing apparatus according to claim 11, wherein the supply ports are inclined at a predetermined angle toward the suction port of the suction nozzle so that swirling flows toward the suction port of the suction nozzle are formed by the heating fluid.

13. The polishing apparatus according to claim 11, wherein the controller controls the pad-temperature regulating device so that a flow rate of the fluid sucked by the suction nozzle is equal to or higher than a flow rate of the heating fluid supplied from the heating fluid nozzle.

* * * * *